United States Patent [19]

Sohler

[11] 4,258,450

[45] Mar. 31, 1981

[54] APPARATUS FOR BLOWING AND SUCTIONING FIBER FLY FROM TEXTILE MACHINES

[75] Inventor: Manfred Sohler, Wangen, Fed. Rep. of Germany

[73] Assignee: Hubert Sohler GmbH, Fed. Rep. of Germany

[21] Appl. No.: 27,206

[22] Filed: Apr. 5, 1979

[30] Foreign Application Priority Data

Apr. 7, 1978 [DE] Fed. Rep. of Germany ..... 2815188

[51] Int. Cl.[3] ..... B08B 5/00

[52] U.S. Cl. ..... 15/312 A; 15/319

[58] Field of Search ..... 15/312 A, 312 R, 319

[56] References Cited

U.S. PATENT DOCUMENTS

| | | | |
|---|---|---|---|
| 2,651,473 | 9/1953 | Siegenthaler | 15/312 R X |
| 3,009,838 | 11/1961 | Preston | 15/312 A X |
| 3,011,204 | 12/1961 | Holtzclaw | 15/312 A |
| 3,051,978 | 9/1962 | Auffrey | 15/319 X |
| 3,276,065 | 10/1966 | King et al. | 15/319 X |
| 4,121,317 | 10/1978 | Sohler | 15/312 A |
| 4,121,318 | 10/1978 | Jacobi | 15/312 A |

FOREIGN PATENT DOCUMENTS

| | | | |
|---|---|---|---|
| 902951 | 1/1954 | Fed. Rep. of Germany | 15/312 R |
| 912258 | 5/1954 | Fed. Rep. of Germany | 15/312 A |

*Primary Examiner*—Christopher K. Moore

*Attorney, Agent, or Firm*—Sprung, Felfe, Horn, Lynch & Kramer

[57] ABSTRACT

A mobile apparatus for pneumatically blowing and suctioning fiber fly or lint from textile machines by means of blowing and suctioning means respectively connected to a common fan by means of nozzles and suction members which sweep past the textile machine and across the floor and between which there is positioned a filter to extract the fiber fly or lint which is adapted to be impinged periodically by the air-blast stream in the opposite direction to clean said filter and convey the fiber fly deposited on said filter into a collection bin. In order to position the apparatus immediately adjacent to the working area, the apparatus is designed to move on a trackway provided on one side of the textile machine. The drive means is adapted to be automatically de-energized and reversed by limit switches provided on the apparatus. The fan is a radial blower fan. The blower wheel thereof is rotatably mounted about a horizontal axis extending transversely to the direction of movement, is provided in the working area of the blowing and suction means and is impinged directly by the fiber fly. The suction means are located substantially below the fan and the filter associated with the pressure conduit leading to the blowing means is located thereabove, said pressure conduit being adapted to be separated from a filter box by a slide which simultaneously opens a by-pass valve, thus deflecting the air-blast stream against the upstream side of the filter, and establishes a connection between said filter box and a collection bin.

13 Claims, 3 Drawing Figures

Figure 1:
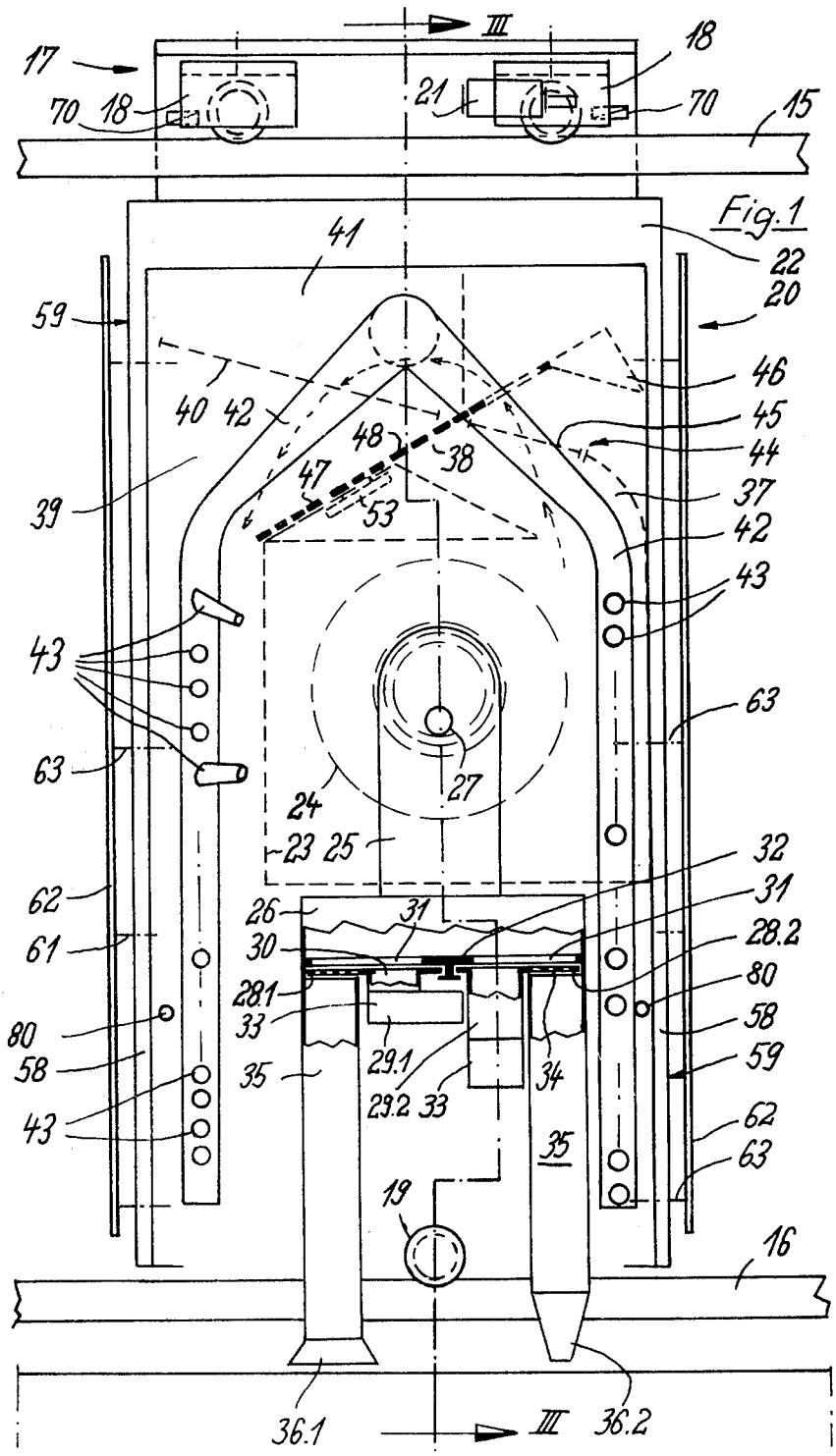

III
17
18
70
18
21
70
15

41
22
20
59
46
40
42
45
48
38
44
47
37
39
53
42
43
43
63
63
27
24
23
25
32
62
26
31
31
61
30
28.2
281
80
80
33
58
58
29.1
59
35
34
29.2
33
43
62
35
63
19
16
36.1
III
36.2

17
15
42
41
40
64
46
63
22
20
48
39
44
45
38
53
37
47
49
23
59
22
59
63
24
62
60
61
26
60
61
62
29.1
29.2
35
35
63
51
64
64
50
36.2
36.1
52

APPARATUS FOR BLOWING AND SUCTIONING FIBER FLY FROM TEXTILE MACHINES

This invention relates to a mobile apparatus for pneumatically blowing and suctioning fiber fly from textile machines by means of blowing and suctioning means respectively connected to a common fan by means of nozzles and terminal suction members which sweep past the textile machine and across the floor and between which there is positioned a filter to extract the fiber fly which is adapted to be impinged periodically by the air-blast stream in the opposite direction to clean said filter and to convey the fiber fly deposited thereon into a collection bin.

DISCUSSION OF THE PRIOR ART

U.S. Pat. No. 4,121,317, issued to Hubert Sohler, shows a pneumatic apparatus which is mounted above the textile machine, which is adapted to be moved along a trackway or rail and which includes long blowing and suctioning hoses, the nozzles and terminal members of which are located near the textile machine and near the floor. The consequence is pressure losses in the long hoses which cannot be compensated for by increasing the output of the fan. Moreover, fiber fly may be deposited in the suction hoses so that these must be cleaned at regular intervals. The freely suspended hoses cannot be moved directly up to the working area and, during forward travel, are subject to pendular motion. Both of these factors necessitates an increase in the fan output.

By contrast, the object of the present invention is to provide a compact apparatus which makes it possible for the apparatus to be moved and positioned immediately adjacent to the working area, thereby achieving specific blowing and suctioning of the fiber fly or lint and thus making a reduction in the requisite fan output possible.

This object is accomplished in accordance with the instant invention in that said apparatus is adapted to move on tracks on one side of said textile machine, that the drive means is adapted to be automatically de-energized and reversed by limit switches, that the fan is provided in the working area of the blowing and suction means, and that first and second suction means are located substantially below said fan and the filter associated with the pressure conduit leading to said blowing means is located thereabove.

The inventive apparatus thus constitutes a compact unit whose space requirements are so minimal that it can be adapted to move in a longitudinal direction laterally adjacent to a textile machine. This is also the case even if there are several rows of machines in the hall. The inventive apparatus moves between two adjacent machines rows along one textile machine, while an auxiliary device moves along the adjacent textile machine and automatically performs the requisite work on this textile machine. The apparatus for pneumatically blowing and suctioning fiber fly is designed to move on the same tracks as the auxiliary unit. The apparatus operates automatically and to this end is equipped with limit switches which respond when the apparatus approaches the auxiliary unit, any obstacles and parts of the textile machine. The fan is located directly in the working area of the blowing and suctioning members, thus necessitating only short conveyance and reversal elements. This minimizes the resistance to the passage of air and, in spite of a low fan output, a high cleaning action can be achieved, since high flow rates and thus more intensive impact of air on the individual parts of the textile machine are possible. The structure of the apparatus is compact, since the blowing elements, which advantageously include the filter, are positioned above the fan, except for a few nozzles, whereas the suction elements are located directly beneath the fan. In this way, the suctioning elements can be directly associated with the spindle area, particularly in twisting machines. A suction opening is advantageously provided as well in the vicinity of the creel. Specially designed nozzles back up and sustain the suctioning capacity in both cases.

The apparatus is also suitable for use with other textile machines such as spinning machines, for example.

A tri-functional slide is expediently provided in the blowing area above the fan. The arrangement is designed such that the pressure conduit is adapted to be separated from a filter box by the slide which simultaneously opens a by-pass valve, thus deflecting the air-blast stream against the up-stream side of the filter, and establishes a connection between the filter box and a collecting bin. Only a single positioning element is required for this slide which regulates three valves at the same time so that considerable simplifications are embodied both in the construction and in the circuitry of the invention. The resultant advantage from the point of view of work is that the fiber fly or lint hanging on the upwardly inclined filter is blown off in a downward direction and is simultaneously conveyed into the collection bin via the inclined slide.

Figure 2:
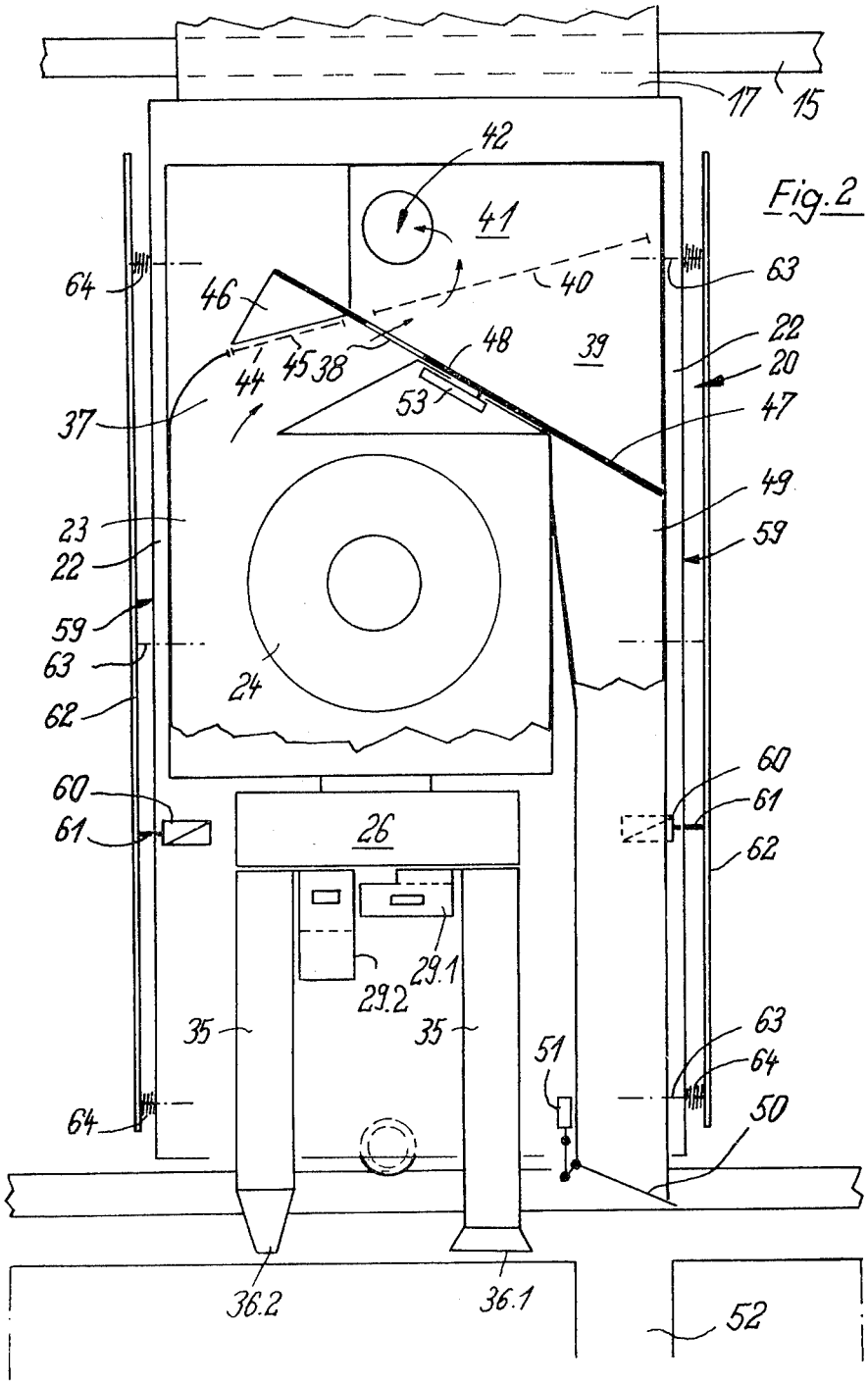

The drawing illustrates one embodiment of the present invention which will be explained in more detail with reference to the following description. In the drawing, FIG. 1 is a partially sectional elevation - when seen from the side of the textile machine - of the apparatus for blowing and suctioning fiber fly during the cleaning process, FIG. 2 is the apparatus according to FIG. 1 - when seen from the other side - during the blowing and suctioning process with the rear wall partially removed, and FIG. 3 is a sectional elevation approximately along line III—III in FIG. 1.

Figure 3:
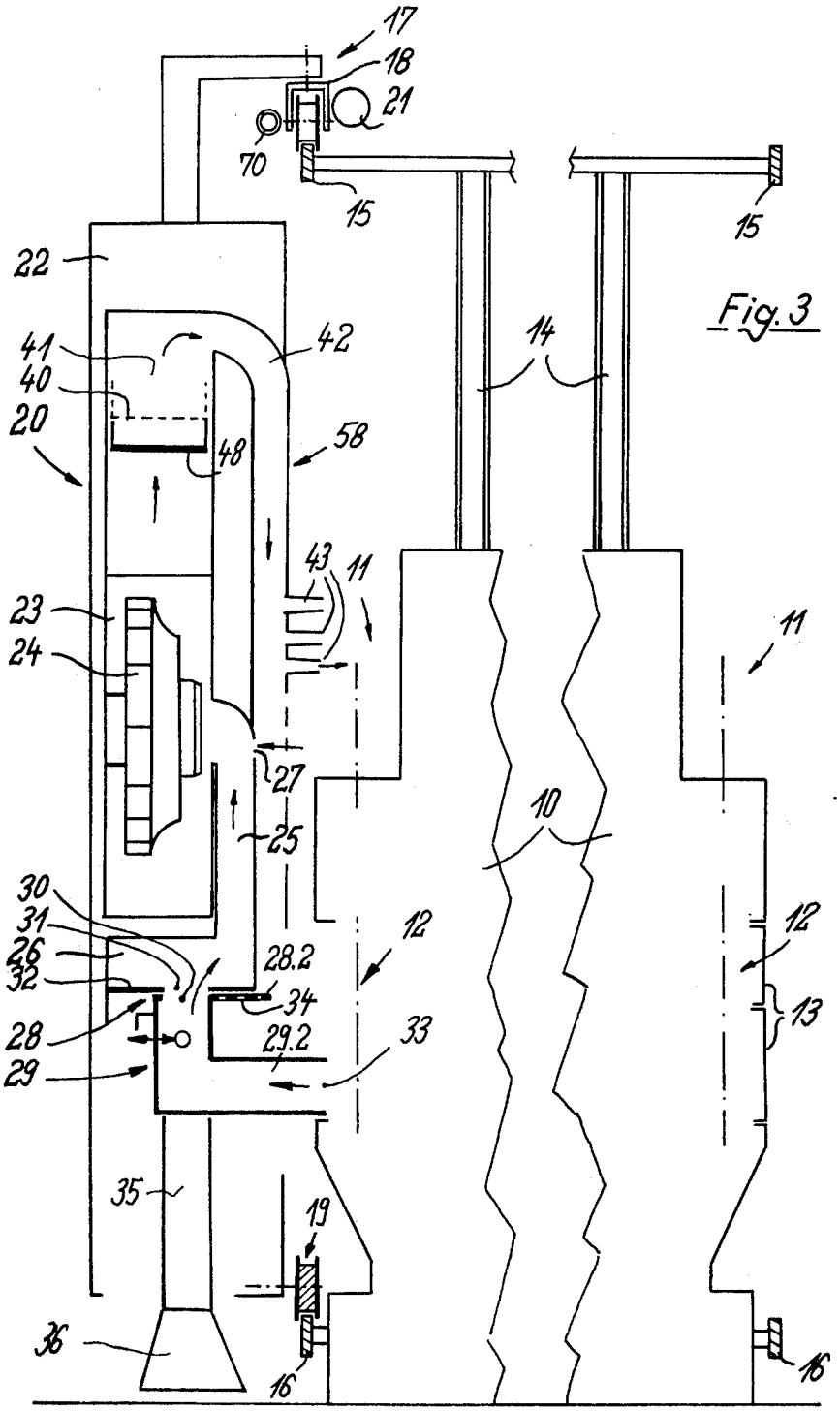

FIG. 3 illustrates a textile machine 10 in schematic cross section which in the embodiment illustrated is a twisting machine. The spindle area 12 which can be closed off by lateral panels 13 is located below the creel indicated at 11. The twisting machine 10 includes creels 11 and spindle areas 12 on both sides. A post 14 with lateral tracks 15 is positioned above the twisting machine 10. Lower tracks 16 may also be provided as well. The tracks 15 and 16 are provided for at least one auxiliary unit (not shown) which automatically carries out work on the textile machine. Since as a rule a plurality of twisting machines 10 are arranged next to one another and are served by a single auxiliary unit, crossover tracks are provided on the face ends of the twisting machines 10 adjacent to the tracks 15 for the purpose of transferring the auxiliary unit from one side of the twisting machine 10 to the other side of the same machine or to a side of a neighboring twisting machine 10. The lower tracks 15 may also be provided with crossover tracks as well.

An upper undercarriage 17 of the apparatus for pneumatically blowing and suctioning fiber fly from the twisting machine 10 is positioned on the upper track 15. To enable to the apparatus 20 to negotiate curves, the upper undercarriage 17 includes at least one swivelling bogie 18. The bogie(s) 18 or the undercarriage 17 have guide rollers which run on the tracks 15 and/or rollers (not shown) which are pivotal about vertical axes and can engage the lateral flanks of the tracks 15. A lower undercarriage 19 is provided at the lower end of the apparatus 20 and includes rollers which engage the lower track 16. At least the upper undercarriage 17 or the swivelling bogie 18 thereof has a drive means 21 which includes an electromotor. The lower undercarriage 19 can also be provided with a drive means as well. The lower undercarriage 19 moves the apparatus parallel to the twisting machine 10 particularly along straight stretches. In this way, it maintains the apparatus 20 in a predetermined position, especially with respect to the spindle area 12.

The apparatus 20 includes a frame 22 which has a flat, rectangular configuration in FIG. 3. It also includes a fan 23 in the central area thereof. The fan 23 in the illustrated embodiment is a radial blower fan, the wheel 24 of which is impinged directly by the fiber fly or lint. The fan 23 comprises a suction conduit 25 connected to a suction box 26 provided immediately below the fan 23. Furthermore, the suction conduit 25 may also be provided with a suction opening or aperture 27 which is located adjacent to the axis of the blower wheel 24.

Two reversing slides 28 are provided in the illustrated embodiment on the bottom of the suction box 26. Each of the two reversing slides 28.1 and 28.2 is rigidly connected to a suctioning element 29.1 and 29.2 and, together therewith, can be displaced towards the spindle area 12. Such displacement can be effected by hand or by a positioning element. Moving the suction element 29 towards the twisting machine 10 brings a communicating aperture 30 in the reversing slide 28 into register with an opening 31 in the bottom 32 of the suction box 26 in such a manner that the terminal end 33 above the suction element, the communicating aperture 30, the opening 31, the suction box 26 and the suction conduit 25 all communicate with the fan 23.

The reversing slides 28.1 and 28.2 each respectively comprises yet another communicating aperture 34 which connects a suction trunk 35 with a terminal suction member 36 at the free end thereof, with the suction box 26 when the suction elements 29 and thus the reversing slides 28 are retracted. The terminal suction members 36.1 and 36.2 are disposed directly above the floor of the factory hall and can be directed either in the direction of travel or transversely thereto.

The pressure conduit 37 associated with the fan 23 is located directly thereabove. The pressure conduit 37 is connected to a filter box 39 via a main valve 38. The filter box 39 is provided with a main filter 40. The main filter 40 is located upstream relative to a pressure chamber 41 leading to pressure lines 42 provided with short nozzles 43 which are directed, in particular, towards the twisting machine 10.

Furthermore, the pressure conduit 37 is also connected to a by-pass valve 44 provided with a secondary filter 45. The by-pass valve 44 is adapted to be closed by a by-pass valve body 46 - FIG. 2 - which is mounted on a slide 48 which opens and closes the main valve 38. The slide 48 has a slide extension 47 which closes a collection bin 49 when the apparatus 20 is in the blowing and suctioning mode. The collection bin 49 is disposed substantially vertically on the frame 22 of the apparatus 20 adjacent to the housing of the fan 23. A valve flap 50 is located at the lower end of the collection bin 49 and is provided with a positioning element 51. If the apparatus 20 is positioned over a central fiber fly suctioning system 52, the valve flap 50 can be opened. The flap 50 can also be replaced by a slide which requires less space.

The slide 48 can be reciprocated by a positioning element 53 and in this way can be moved from the blowing and suctioning mode according to FIG. 2 to the cleaning mode according to FIG. 1 and vice-versa. In the cleaning mode according to FIG. 1, the main valve 38 is closed by the slide 48, the by-pass valve body 46 is raised by the slide 48 so that the by-pass valve 44 is open and the air-blast stream passes through the filter 45 and impinges on the main filter 40 from the pressure chamber 41. In addition, the slide extension 47 is retracted so that the fiber fly or lint in the filter box 39 is conducted into the collection bin 49.

Encounter limit switches 60 are provided on the narrow sides 59 of the frame 22 of the apparatus 20. These limit switches 60 are operable by rods 61 connected to buffer elements 62. These buffer elements 62 are adjustably mounted on the narrow sides 59 of the frame 22 so that they can be moved in the direction of travel by bars 63, the action of compression springs 64, however, causing them to be held in the inoperative position at a specific distance from the narrow sides 59 of the apparatus 20. The buffer elements 62 can be lattice frames which are mounted non-rigidly and, on contact with an obstacle such as another device travelling along the tracks 15,16, a balling carriage, a tool carriage, a person or the like, are moved towards the associated narrow side 59, thereby displacing the rod 61 and triggering the limit switch 60. The limit switch 60 immediately interrupts the power supply to the drive means 21 and can subsequently reverse this power supply such that the apparatus 20 is moved in the opposite direction away from the obstacle. In so doing, the displaced buffer element 62 again returns to its inoperative position.

Spacing limit switches 70, also pointing in both directions of movement - are disposed on the narrow sides 59 of the frame 22 or preferably - as illustrated - on the swivelling bolsters 18 of the undercarriage 17. The spacing limit switches 70 are expediently provided with photocells which respond to an actuator mounted on the auxiliary unit(s) (not shown) which also travel along the tracks 15,16. The actuator can consist of a reflecting material, the actuator and the photocell being designed and positioned such that they respond and actuate the spacing limit switches 70 when the apparatus 20 has approached the auxiliary unit, for instance, to within a distance of 150 cm (5 ft). In this case, the spacing limit switch 70 interrupts the power supply to the drive means 21 and subsequently reverses it.

Advancing limit switches 80 are disposed on the broad side 58 of the frame 22 pointing towards the twisting machine 10 approximately adjacent to the two narrow sides 59 at the level of the suction elements 29. The advancing limit switches 80 can only be actuated if the suction elements 29 are displaced towards the twisting machine 10. For this purpose, the suction elements 29 and the slides 32 are associated with interrupters (not shown). If, after removal of the panels 13 from the spindle area 12, the terminal ends 33 move towards the spindle area 12, the advancing limit switches 80 are actuated. They expediently operate as proximity detectors, but can also be provided as well with mechanical actuating means. As soon as an advancing limit switch 80 impinges on a panel 13 which has accidentally not yet been opened, it interrupts the power supply to the drive means 21. At the same time, the drive means can be reversed. On the other hand, if all panels 13 have been opened and the advancing limit switch 80 impinges on the machine housing at the end of the twisting machine 10, it can also stop and then reverse the drive means. The apparatus 20 is then moved in the opposite direction of travel until the other advancing limit switch 80 impinges on the machine housing at the other face end of the twisting machine 10, once again stopping and reversing the drive means. This thus makes it possible to clean the spindle area 12 intensively by repeatedly moving the apparatus 20 along the same side of the twisting machine 10.

The suction opening 27 points towards the creel 11 and the nozzles 43 can point in the same direction and, at the same time, be inclined somewhat towards the suction conduit 25. In this manner, very high velocities are produced adjacent to the creel which make it possible to remove fiber fly or lint adhering to machine parts.

To achieve automatic operation, pulse generators can also be provided in the floor or tracks 15,16 which stop the apparatus 20 adjacent to the lint suction opening 52, for instance, and actuate the positioning element 51, thus causing the flap 50 to open.

What is claimed is:

1. In a textile machine cleaning apparatus for pneumatically blowing and removing particulate matter from at least one elongated textile machine, comprising: an air flow producing fan having on the suction side thereof suction applying means and on the pressure side thereof blowing means, filter means for removing entrained particles from air passed through said fan during most of the operating time and means adapted to alternately and separately detach said particles collected on said filter means therefrom and to convey said detached particles into a collection bin, the improvement which comprises a supporting trackway on either side of said textile machine, said cleaning apparatus adapted to move on said supporting trackway and being driven therealong by drive means, limit switch means actuated by a specific interaction with another machine along the path of movement of said cleaning apparatus to alter the condition of power supply to said drive means, first and second suction applying means for sucking lint from one side of said textile machine and third suction applying means for sucking fiber waste from the floor surrounding said textile machine, said first, second and third suction applying means comprising suction conduits, the suction conduits of said suction applying means being located at least partially below said fan and in fluid connection with said fan to impinge air entrained particles directly against the center of said fan whereby said particles are conveyed to said filter means, which is disposed above said fan and in fluid communication with said blowing means which comprises a vertically spaced array of blowing nozzles communicating therewith whereby an air stream, free of particles, is blown through said blowing means continuously.

2. An apparatus according to claim 1 wherein said supporting trackway comprises an upper track and a lower track, both extending parallel to either side of at least one said textile machine, at least the upper track of which takes the form of an endless supporting trackway, an upper undercarriage being guided on said upper track and comprising at least one bogie, a lower undercarriage being engaged with said lower tracks which guides said cleaning machine in a predetermined relative position with respect to said side of said textile machine.

3. An apparatus according to claim 1 further comprising buffer means which are displaceably mounted on the end faces of said cleaning apparatus pointing in the direction of its movement, said buffer means being spaced from said end faces by compression springs said buffer means are adapted to actuate via roda encounter limit switches of said limit switch means whereby to alter the condition of power supply to said drive means when one of said buffer means encounters an obstacle.

4. An apparatus according to claim 1 wherein said supporting trackway comprises an upper track and a lower track, said upper track engages an upper undercarriage attached to said cleaning apparatus, said lower track engages a lower undercarriage attached to said cleaning apparatus, spacing limit switches of said limit switch means point in one of the two directions of movement of said cleaning apparatus, said undercarriages comprise rollers guided on said tracks extending parallel to said textile machine, which spacing limit switches at a predetermined distance respond to an actuator provided on an auxiliary unit which is also adapted to move on said upper track and said lower track and alter the condition of power supply to said drive means as soon as the actuator reaches the predetermined distance.

5. An apparatus according to claim 4 wherein said spacing limit switch comprises a photo cell associated with each spacing limit switch which is energized by said actuator on said auxiliary unit, said actuator comprising reflecting means for reflecting light to said photo-cell.

6. An apparatus according to claim 1 wherein said air flow producing fan is a radial blower fan having a horizontal axis extending transversely to the direction of advance of said cleaning apparatus along said supporting trackway and the central intake of said radial blower fan is substantially in line with said second suction applying means for sucking lint from said one side of said textile machine.

7. An apparatus according to claim 1 wherein said first and third suction applying means comprise a common suction box located below said fan and communicating with the fan central intake, which suction box is provided with at least one reversing slide alternately connecting said first or said third suction applying means to said suction box, said fan being a radial blower fan having a horizontal axis.

8. An apparatus according to claim 1 wherein said first and third suction applying means comprise a common suction box located below said fan and communicating with the fan central intake, which suction box is provided with at least one reversing slide alternately connecting said first or said third suction applying means to said suction box, said fan being a radial blower fan having a horizontal axis, said first suction applying means for sucking lint from said one side of said textile machine further comprising a tubular suction element having an inlet opening facing said textile machine, said reversing slide and said tubular suction element being adapted to be displaced horizontally together towards said textile machine to connect said inlet opening to said suction box and away from said first suction supplying means to said suction box and to establish a second connection from said third suction applying means to said suction box, said third suction applying means comprising a vertical suction trunk provided with a terminal suction member near the floor surrounding said textile machine.

9. An apparatus according to claim 8 wherein said suction box is provided with two reversing slides each of said reversing slides being associated with a corresponding suction element and suction trunk.

10. An apparatus according to claim 1 wherein said first and third suction applying means comprise a common suction box located below said fan and communicating with a fan central intake of said fan which suction box is provided with at least one reversing slide alternately connecting said first or said third suction applying means to said suction box, said fan being a radial blower fan having a horizontal axis, said first suction applying means for sucking lint from said one side of said textile machine further comprising a tubular suction element having an inlet opening facing said textile machine being adapted to be displaced horizontally together towards said textile machine to connect said inlet opening to said suction box and away from said textile machine to interrupt the connection from said first suction applying means to said suction box and to establish a second connection from said third suction applying means to said suction box, said third suction applying means comprising a vertical suction trunk provided with a terminal suction member near the floor surrounding said textile machine, said apparatus further comprising at least one sensing advance limit switch associated with said tubular suction element and pointing towards said textile machine to alter the condition of power supply to said drive means in the event said advance limit switch engages said textile machine.

11. An apparatus according to claim 1 wherein said air flow producing fan is a radial blower fan having a horizontal axis extending transversely to the direction of movement of said cleaning apparatus along said supporting trackway, said blowing means comprise a pressure conduit between said fan and a first valve adapted to separate said pressure conduit from a filter box, said filter box comprising said filter means and a second valve adapted to separate said filter box from said collection bin, said blowing means further comprising a pressure chamber located on the downstream side of said filter means from said filter box and being provided with pressure lines leading to said blowing nozzles, a by-pass connecting said pressure conduit to said pressure chamber, said bypass comprising a third valve and a secondary filter means, a unitary slide being provided for all three valves which slide moves from its first position during most of the operating time in which said slide opens said first valve and closes said second valve and third valve, to in its second position in which said slide closes the first valve and opens the second valve and said third valve thus deflecting the air stream through said pressure chamber against the downstream side of said filter means and establishing connection between said filter box and said collection bin for detaching said particles collected on said filter means and conveying said detached particles into said collection bin.

12. An apparatus according to claim 11 wherein said slide is moved from its first position to its second position and vice versa by means of a positioning element.

13. An apparatus according to claim 1 wherein said drive means are further controlled by pulses provided by a sensor which is adapted to be energized by at least one transmitter disposed along said supporting trackway.

* * * * *